US005937227A

United States Patent [19]

Wong et al.

[11] Patent Number: 5,937,227

[45] Date of Patent: Aug. 10, 1999

[54] UNCOUPLED TONER CONCENTRATION AND TRIBO CONTROL

[75] Inventors: Lam F. Wong, Fairport; David C. Craig, Rochester, both of N.Y.

[73] Assignee: Xerox Corporation, Stamford, Conn.

[21] Appl. No.: 08/926,476

[22] Filed: Sep. 10, 1997

[51] Int. Cl.[6] ..... G03G 15/00

[52] U.S. Cl. ..... 399/49; 399/58

[58] Field of Search ..... 399/49, 58, 258, 399/72

[56] References Cited

U.S. PATENT DOCUMENTS

| | | | |
|---|---|---|---|
| 4,318,610 | 3/1982 | Grace | 399/49 |
| 4,348,099 | 9/1982 | Fantozzi . | |
| 4,533,234 | 8/1985 | Watai et al. | 399/49 |
| 4,553,033 | 11/1985 | Hubble, III et al. | 250/353 |
| 5,202,769 | 4/1993 | Suzuki | 358/300 |
| 5,204,698 | 4/1993 | LeSueur et al. | 347/140 |
| 5,298,944 | 3/1994 | Sawayama et al. | 399/49 |
| 5,351,107 | 9/1994 | Nakane et al. | 399/49 |
| 5,383,005 | 1/1995 | Thompson et al. . | |
| 5,416,564 | 5/1995 | Thompson et al. . | |
| 5,436,705 | 7/1995 | Raj . | |
| 5,559,579 | 9/1996 | Gwaltney et al. | 399/59 |
| 5,581,326 | 12/1996 | Ogata et al. | 399/30 |
| 5,652,947 | 7/1997 | Izumizaki | 399/58 |
| 5,678,131 | 10/1997 | Alexandrovich et al. | 399/58 |
| 5,708,916 | 1/1998 | Mestha | 399/49 |
| 5,749,021 | 5/1998 | Mestha et al. | 399/49 |
| 5,797,064 | 8/1998 | Raj et al. | 399/46 |

FOREIGN PATENT DOCUMENTS

| | | |
|---|---|---|
| 55-101968 | 8/1980 | Japan . |
| 03 191371 | 8/1991 | Japan . |

*Primary Examiner*—Robert Beatty
*Attorney, Agent, or Firm*—Ronald F. Chapuran

[57] ABSTRACT

A method adjusting variations in toner concentration in a printing machine by first determining a pixel count of documents to be imaged. The system then provides two test targets on the imaging surface in the image area, one of the test targets having a relatively low reflectance and the other test target having a medium reflectance. The reflectance value of the test targets is sensed and the difference between the reflectance values is calculated and compared to a reference value to provide an error value. The system then to the error value and the pixel count of documents to be imaged to determine a time period of dispense for a toner dispenser.

11 Claims, 7 Drawing Sheets

UNCOUPLED TONER CONCENTRATION AND TRIBO CONTROL

BACKGROUND OF THE INVENTION

The invention relates to xerographic process control, and more particularly, to the compensation for higher or lower toner concentration levels.

Typically, an electrophotographic process is controlled by adjusting development field, cleaning field, exposure intensity, and toner concentration. An electrostatic voltmeter is used to measure the electrostatic fields. The electrostatic fields are adjusted successively to establish a desired operating range. Voluminous data is collected and analyzed to generate lookup tables in order to bring the density of an image, the developed mass per unit area within prescribed limits.

A common technique for monitoring developed mass per unit area is to artificially create a "test patch" of a predetermined desired density. The actual density of the printing material (toner or ink) in the test patch can then be optically measured to determine the effectiveness of the printing process in placing this printing material on the print sheet.

The optical device for determining the density of toner on the test patch, which is often referred to as a "densitometer", is disposed along the path of the photoreceptor, directly downstream of the development of the development unit. There is typically a routine within the operating system of the printer to periodically create test patches of a desired density at predetermined locations on the photoreceptor by deliberately causing the exposure system thereof to charge or discharge as necessary the surface at the location to a predetermined extent.

The test patch is then moved past the developer unit and the toner particles within the developer unit are caused to adhere to the test patch electrostatically. The denser the toner on the test patch, the darker the test patch will appear in optical testing. The developed test patch is moved past a densitometer disposed along the path of the photoreceptor, and the light absorption of the test patch is tested; the more light that is absorbed by the test patch, the denser the toner on the test patch.

In the prior art U.S. Pat. No. 4,348,099 discloses a control system for use in an electrophotographic printing machine. A charge control loop, an illumination control loop, a bias control loop, and a toner dispensing loop are provided. Test patches, an infrared densitometer, and an electrometer are used to measure charge level, exposure intensity, toner concentration, and developer bias.

U.S. Pat. No. 4,553,033 discloses an infrared densitometer for measuring the density of toner particles on a photoconductive surface. A tonal test patch is projected by a test patch generator onto the photoconductive surface. The patch is then developed with toner particles. Infrared light is emitted from the densitometer and reflected back from the test patch. Control circuitry, associated with the densitometer, generated electrical signals proportional to the developer toner mass of the test patch.

U.S. Pat. No. 5,416,564 and U.S. Pat. No. 5,383,005 disclose a current sensing device that generates electrical signals proportional to the current flow between the photoconductive surface and a development station as toner is applied to the photoconductive surface at pre-determined regions or patches. A charging device is controlled in response to the generated signals.

U.S. Pat. No. 5,436,705 discloses an adaptive process control including the use of signals from both a toner area coverage sensor representing a toner reproduction curve and a toner concentration sensor to compensate for image quality due to material aging and environmental changes.

Prior art control processes often rely on various halftone patches to control TC/tribo (Toner Concentration/triboelectricity) and electrostatics in order that image quality outputs such as toner mass per unit area and tone reproduction curve can meet their targets and be maintained. Under normal circumstances and provided that the system is time invariant, such controls may work well.

However, the environmental noise, the customer usage noise, the subsystem design variations, the consumable (toner developer) noise, and interactions between electrostatics and TC/tribo often make the control extremely difficult. This type of control scheme has a strong coupling between the electrostatic actuators and the TC actuator.

With neither an electrostatic voltmeter (ESV) nor a TC sensor, the system depends on time invariant distinct characteristics of the various patches with respect to each and every actuator to control the system and keep the actuators within their normal operating ranges. If the system is not truly time invariant, many system characteristics are no longer unique and distinguishable. Interactions take over and may drive the system to very strange operating spaces.

Furthermore, satisfying the patches alone does not guarantee TMA control which is very important for fusing and many image quality attributes. TMA is a function of the patch RR's (relative reflectance), tribo, the exposure region of the photoreceptor PIDC, cleaning voltage, and the hardware. Again, without an ESV and TC sensor, the consistent control of TMA is difficult. To make matters worse, hardware variations and uncontrollable noises are often excessive.

In essence there are too many unknowns and not enough information (or knowledge) to ensure a robust control system. Current coupled (electrostatics and TC/tribo) control schemes can easily be confused and create an internal compensation problem, that is, the lowering of the electrostatics to compensate for an over tone situation or vice versa.

It would be desirable, therefore, to be able to overcome the above development control difficulties in the prior art.

It is an object of the present invention therefore to provide a new and improved technique for process control, in particular, allowing the setup and control of the TC and tribo characteristics in all environments independent of the process control electrostatics. It is another object of the present invention to provide uncoupled TC/tribo control using the same halftone patches as in existing process controls, in particular, using only a toner area coverage sensor to measure the relative reflectance of test patches. Another object of the present invention is to be able to control TC and automatically compensate to changes in the environment and to control TC and yet be insensitive to a temporary decay of tribo (such as an overnight rest) to avoid TC tone down spiral problems. Other advantages of the present invention will become apparent as the following description proceeds, and the features characterizing the invention will be pointed out with particularity in the claims annexed to and forming a part of this specification.

SUMMARY OF THE INVENTION

The present invention is concerned with a method of adjusting variations in toner concentration in a printing machine by first determining a pixel count of documents to be imaged. The system then provides two test targets on the imaging surface in the image area, one of the test targets having a relatively low reflectance and the other test target having a medium reflectance. The reflectance value of the test targets is sensed and the difference between the reflectance values is calculated and compared to a reference value to provide an error value. The system reacts to the error value and the pixel count of documents to be imaged to determine a time period of dispense for a toner dispenser.

DETAILED DESCRIPTION OF THE DRAWINGS

For a better understanding of the present invention, reference may be had to the accompanying drawings wherein the same reference numerals have been applied to like parts and wherein.

DETAILED DESCRIPTION OF THE PREFERRED EMBODIMENT

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 1:
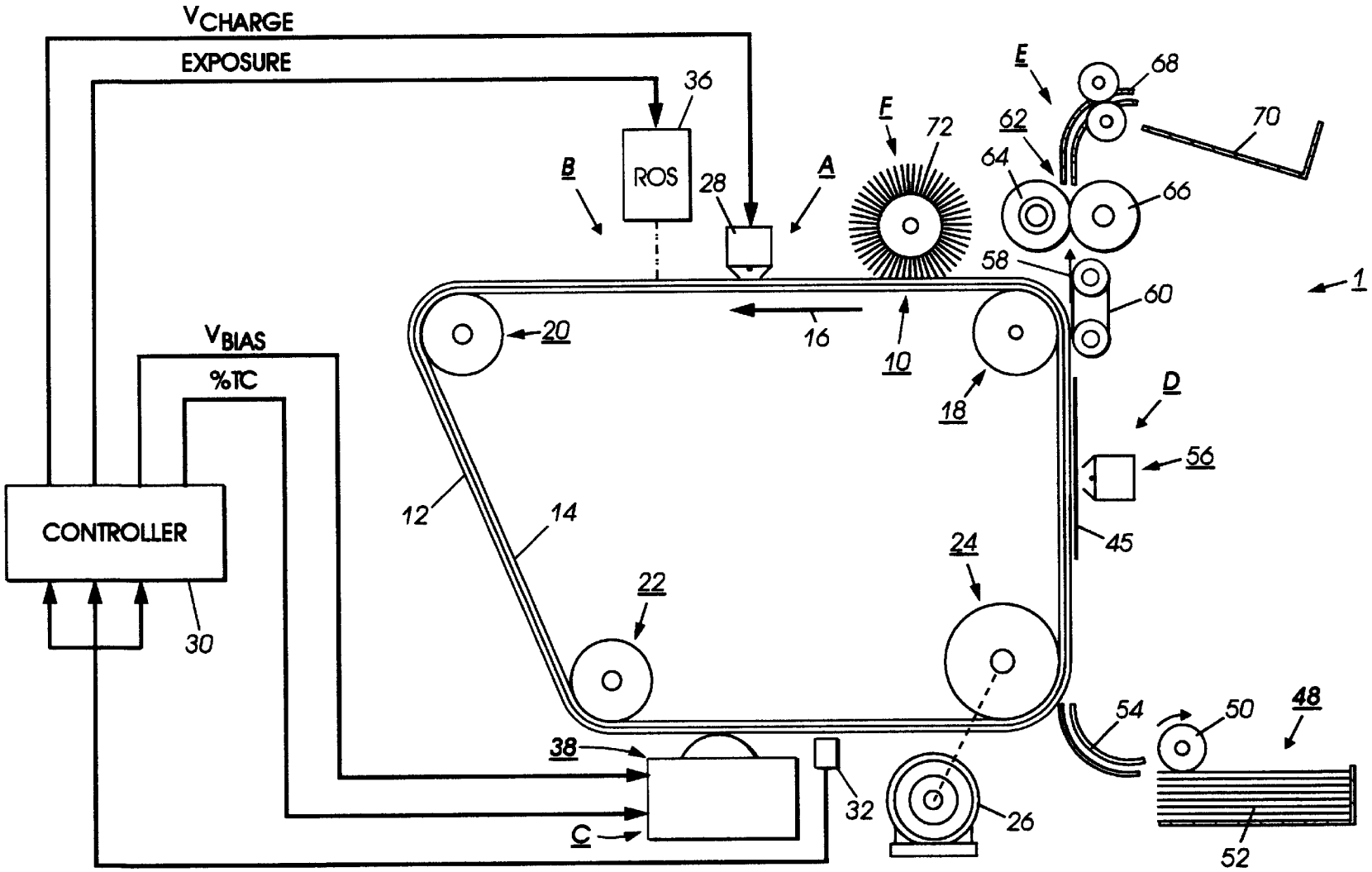
FIG. 1 is an elevational view illustrating a typical electronic imaging system incorporating background detection and compensation in accordance with the present invention.

Turning to FIG. 1, the electrophotographic printing machine 1 employs a belt 10 having a photoconductive surface 12 deposited on a conductive substrate 14. By way of example, photoconductive surface 12 may be made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22, 24. Roller 24 is coupled to motor 26 which drives roller 24 so as to advance belt 10 in the direction of arrow 16. Rollers 18, 20, and 22 are idler rollers which rotate freely as belt 10 moves in the direction of arrow 16.

Initially, a portion of belt 10 passes through charging station A. At charging station A, a corona generating device, indicated generally by the reference numeral 28 charges a portion of photoconductive surface 12 of belt 10 to a relatively high, substantially uniform potential.

Next, the charged portion of photoconductive surface 12 is advanced through exposure station B. At exposure station B, a Raster Input Scanner (RIS) and a Raster Output Scanner (ROS) are used to expose the charged portions of photoconductive surface 12 to record an electrostatic latent image thereon. The RIS (not shown), contains document illumination lamps, optics, a mechanical scanning mechanism, and photosensing elements such as charged couple device (CCD) arrays. The RIS captures the entire image from the original document and converts it to a series of raster scan lines. The raster scan lines are transmitted from the RIS to a ROS 36.

ROS 36 illuminates the charged portion of photoconductive surface 12 with a series of horizontal lines with each line having a specific number of pixels per inch. These lines illuminate the charged portion of the photoconductive surface 12 to selectively discharge the charge thereon. An exemplary ROS 36 has lasers with rotating polygon mirror blocks, solid state modulator bars and mirrors. Still another type of exposure system would merely utilize a ROS 36 with the ROS 36 being controlled by the output from an electronic subsystem (ESS) which prepares and manages the image data flow between a computer and the ROS 36. The ESS (not shown) is the control electronics for the ROS 36 and may be a self-contained, dedicated minicomputer. Thereafter, belt 10 advances the electrostatic latent image recorded on photoconductive surface 12 to development station C.

One skilled in the art will appreciate that a light lens system may be used instead of the RIS/ROS system heretofore described. An original document may be positioned face down upon a transparent platen. Lamps would flash light rays onto the original document. The light rays reflected from original document are transmitted through a lens forming a light image thereof. The lens focuses the light image onto the charged portion of photoconductive surface to selectively dissipate the charge thereon. This records an electrostatic latent image on the photoconductive surface which corresponds to the informational areas contained within the original document disposed upon the transparent platen.

At development station C, magnetic brush developer system, indicated generally by the reference numeral 38, transports developer material comprising carrier granules having toner particles adhering triboelectrically thereto into contact with the electrostatic latent image recorded on photoconductive surface 12. Toner particles are attracted form the carrier granules to the latent image forming a powder image on photoconductive surface 12 of belt 10.

After development, belt 10 advances the toner powder image to transfer station D. At transfer station D a sheet of support material 45 is moved into contact with the toner powder image. Support material 45 is advanced to transfer station D by a sheet feeding apparatus, indicated generally by the reference numeral 48. Preferably, sheet feeding apparatus 48 includes a feedroll 50 contacting the uppermost sheet of a stack of sheets 52. Feed roll 50 rotates to advance the uppermost sheet from stack 50 into sheet chute 54. Chute 54 directs the advancing sheet of support material 45 into a contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 45. This attracts the toner powder image from photoconductive surface 12 to sheet 45. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 45. Preferably, fuser assembly 62 includes a heated fuser roller 64 driven by a motor and a backup roller 66. Sheet 45 passes between fuser roller 64 and backup roller 66 with the toner powder image contacting fuser roll 64. In this manner, the toner powder image is permanently affixed to sheet 45. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a preclean corona generating device (not shown) and a rotatably mounted preclean brush 72 in contact with photoconductive surface 12. The preclean corona generator neutralizes the charge attracting the particles to the photoconductive surface. These particles are cleaned from the photoconductive surface by the rotation of brush 72 in contact therewith. One skilled in the art will appreciate that other cleaning means may be used such as a blade cleaner. Subsequent to cleaning, a discharge lamp (not shown) discharges photoconductive surface 12 with light to dissipate any residual charge remaining thereon prior to the charging thereof for the next successive imaging cycle.

In order to maintain image quality and compensate for copy to copy density variations there is provided controller 30 that controls the tonal reproduction curve. Controller 30 adjusts compensation filters in real time to control parameter variations. Controller 30 divides the adaptive control into two tasks, parameter identification and control modification. The estimated results are used to modify the compensation parameters. Changes in output generated by the controller 30 are measured by a toner area coverage (TAC) sensor 32. TAC sensor 32, which is located after development station C, measures the developed toner mass for difference area coverage patches recorded on the photoconductive surface 12. The manner of operation of the TAC sensor 32, shown in FIG. 1, is described in U.S. Pat. No. 4,553,003 to Hubble et al. which is hereby incorporated in its entirety into the instant disclosure. TAC sensor 32 is an infrared reflectance type densitometer that measures the density of toner particles developed on the photoconductive surface 12.

Figure 2:
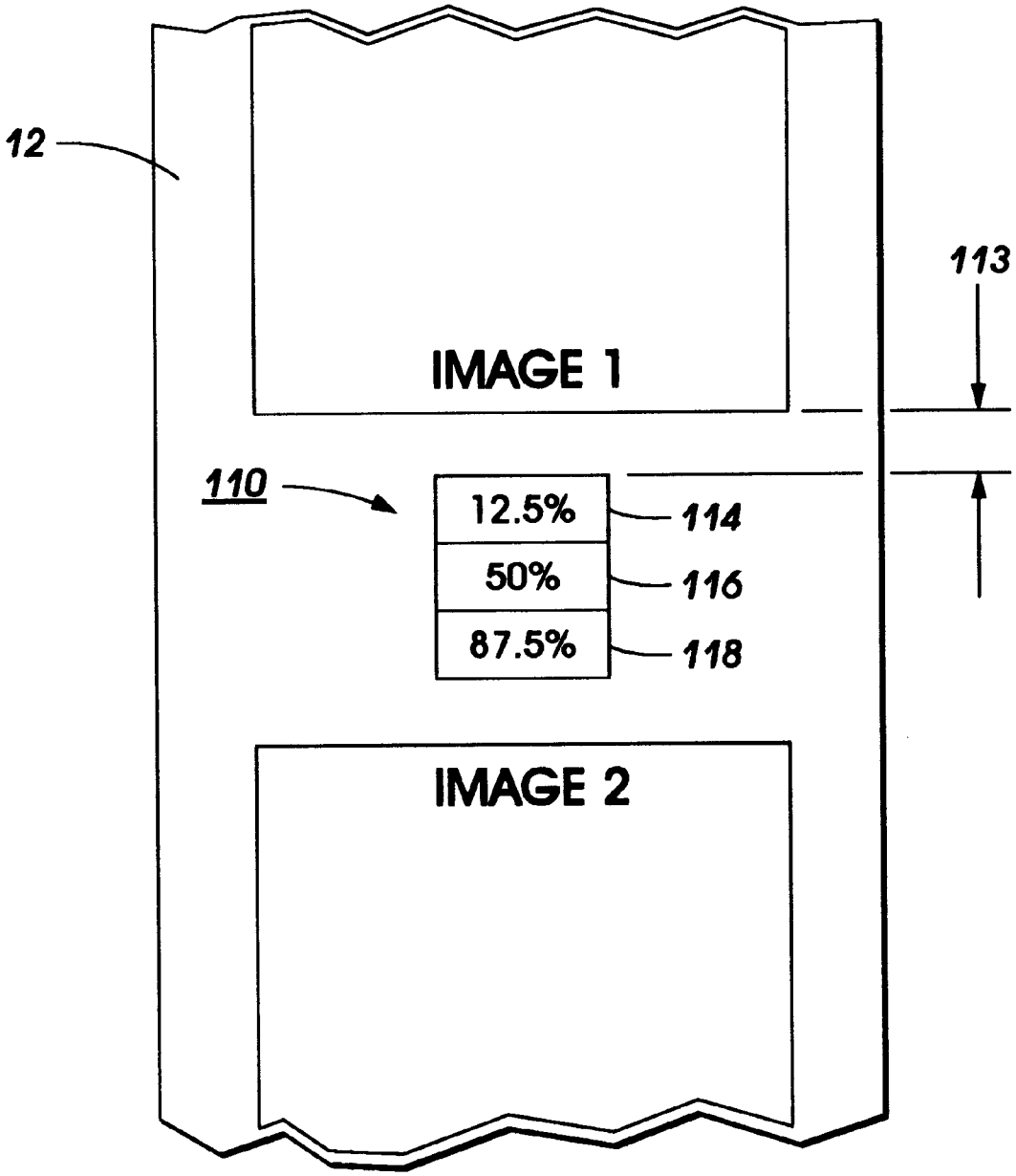
FIG. 2 illustrates a target area interposed between adjacent images on a photoconductive member.

Referring to FIG. 2, a composite toner test patch 110 is imaged in the interdocument area of photoconductive surface 12. The photoconductive surface 12, is illustrated as containing two documents images image 1 and image 2. The test patch 110 is shown in the interdocument space between image 1 and image 2 and in that portion of the photoconductive surface 12 sensed by the TAC sensor 32 to provide the necessary signals for control. The composite patch 110 measures 15 millimeters, in the process direction, and 45 millimeters, in the cross process direction. It includes 3 targets, specifically a 12.5% highlight density shown at 114, a 50% halftone density shown at 116, and an 87.5% solid area density shown at 118.

Before the TAC sensor 32 can provide a meaningful response to the relative reflectance of a patch, the TAC sensor 32 can be calibrated by measuring the light reflected from a bare or clean area portion 113 of photoconductive belt surface 12. For calibration purposes, current to the light emitting diode (LED) internal to the TAC sensor 32 is increased until the voltage generated by the TAC sensor 32 in response to light reflected from the bare or clean area 113 is between 3 and 5 volts. It should also be noted that, in accordance with the present invention, at selected process times, target images are provided in the image area of the photoreceptor, specifically a 12.5% and a 50% target patch are provided in the image area during a toner concentration set up phase and during a control phase when the machine skips a pitch during operation.

Figure 3:
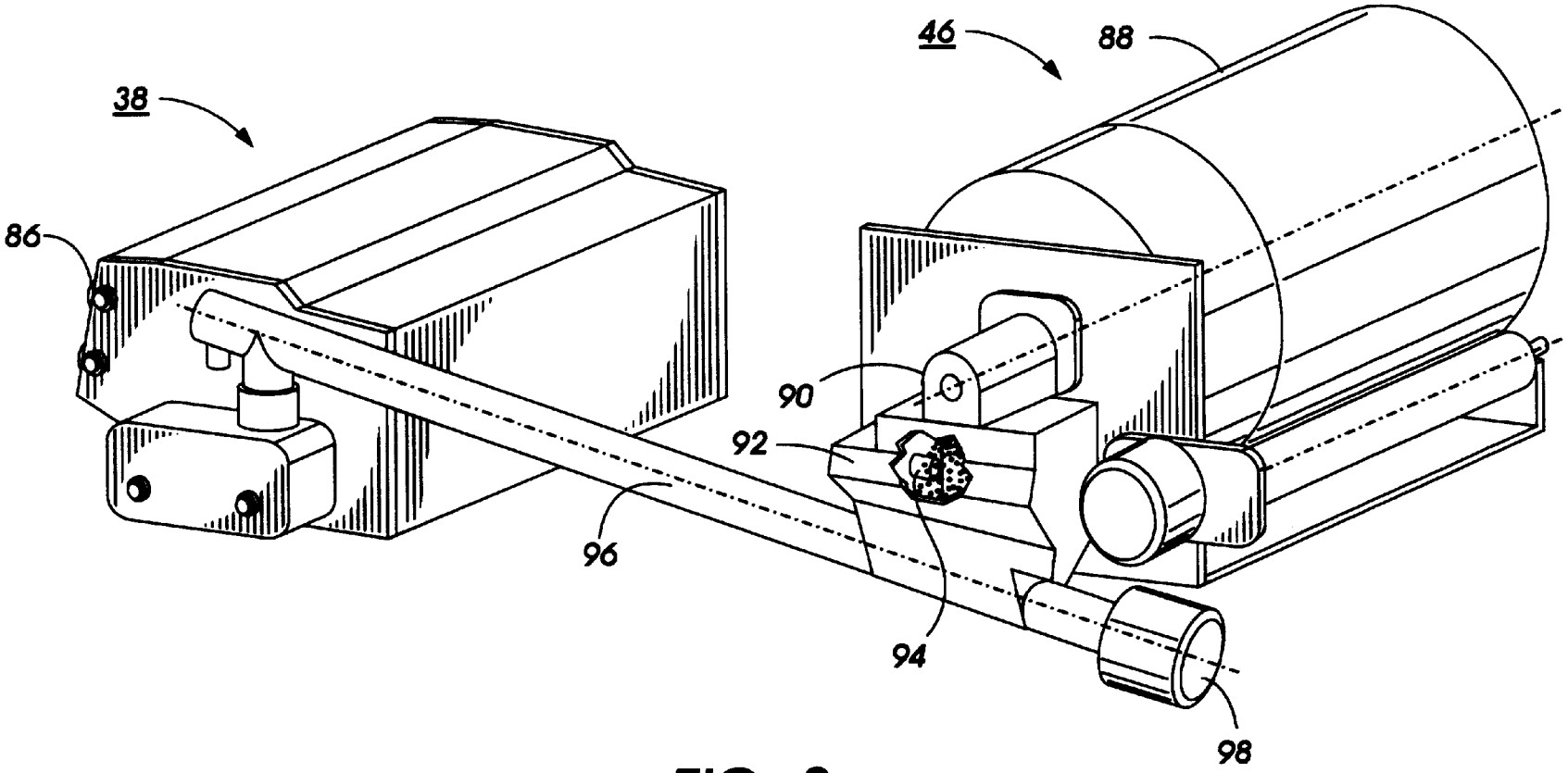
FIG. 3 illustrates a developer unit including a toner dispensing device for use with the present invention.

FIG. 3 shows in greater detail developer unit 38 illustrated in FIG. 1. The developer unit includes a developer 86 such as a mag brush developer for applying toner to a latent image. The magnetic brush developer is generally provided in a developer housing and the rear of the housing usually forms a sump containing a supply of developing material. A (not shown) passive crossmixer in the sump area generally serves to mix the developing material. It should be noted that mag brush development is only one example of a development system contemplated within the scope of the present invention.

As will be understood by those skilled in the art, the electrostatically attractable developing material commonly used in magnetic brush developing apparatus comprises a pigmented resinous powder, referred to as toner and larger granular beads referred to as carrier. To provide the necessary magnetic properties, the carrier is comprised of a magnetizable material such as steel. By virtue of the magnetic field established by the magnetic brush developer, a blanket of developing material is formed along the surface of the magnetic brush developer adjacent the photoreceptor surface. Toner is attracted to the electrostatic latent image from the carrier beads to produce a visible powder image on the surface.

The developer 86 is connected to a toner dispense assembly shown at 46 including a toner bottle 88 providing a source of toner particles, an extracting auger 90 for dispensing toner particles from bottle 88, and hopper 92 receiving toner particles from auger 90. Hopper 92 is also connected to delivery auger 96 and delivery auger is rotated by drive motor 98 to convey toner particles from hopper 92 for distribution to developer 86. A suitable low toner level sensor shown at 94 provides signals to the system control that toner bottle 88 must be re-filled or replaced.

Figure 4:
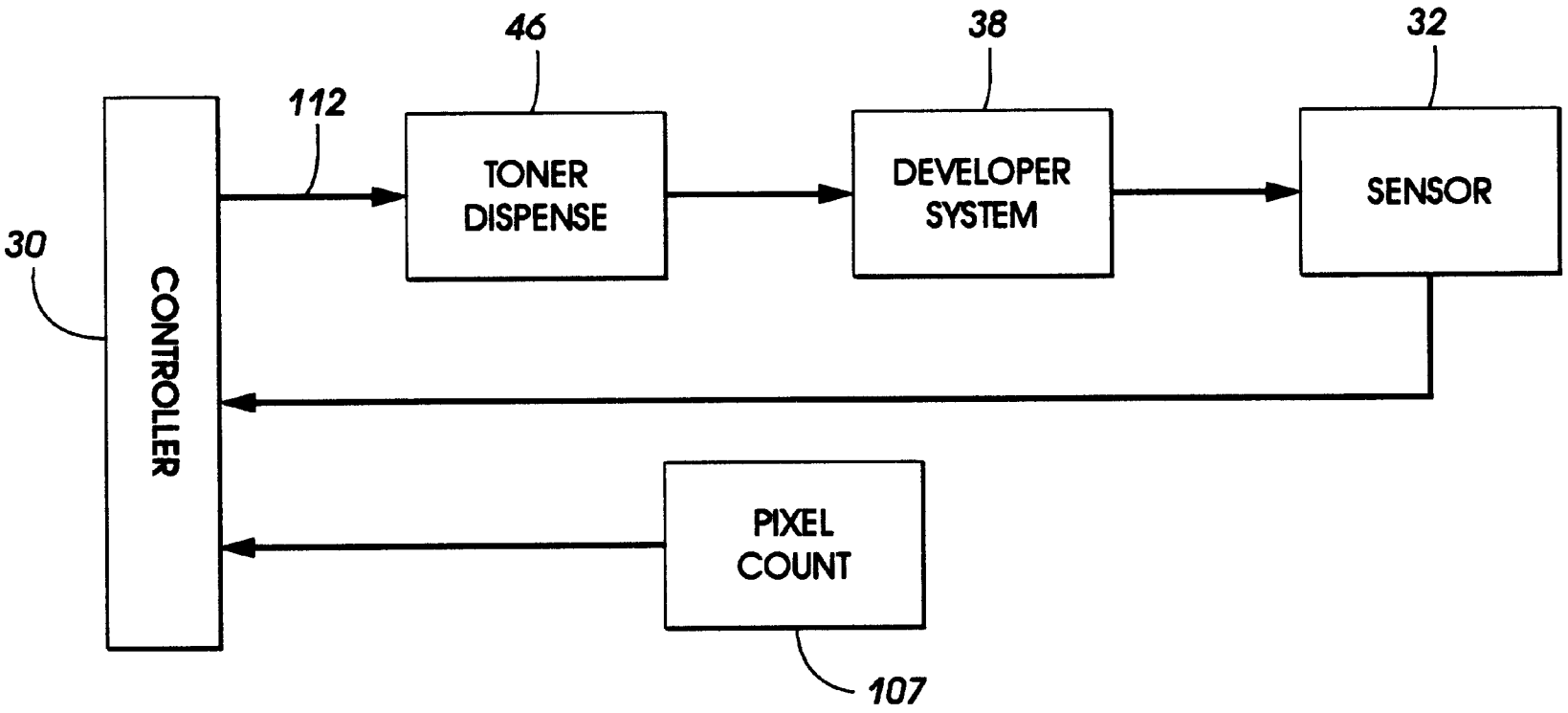
FIG. 4 shows a general control for the device in FIG. 3.

The toner dispense control, in accordance with the present invention, is illustrated in FIG. 4. In particular, toner dispense system 46 replenishes the supply of toner of development system 38. A suitable sensor as illustrated at 32 provides a signal representative of toner concentration to 30. The sensor signals including the sensed 12.5%, 50%, and 87.5% target patches signals at the appropriate control timed intervals and locations. The controller 30 responds to the sensed signals and calculates the delta or difference between the 12.5% and the 50% signals as well as responds to the pixel count illustrated at 107 to provide a toner dispense signal 112 to toner dispense system 46 to add toner to developer system 38. Controller also initiates during TC set up the required cleaning copies if toner must be depleted from the developer.

In accordance with the present invention, there is described an uncoupled TC/Tribo Control. That is, the TC/tribo is controlled independently of the electrostatics. With the TC/tribo under control which is better than control only by a TC sensor (controlling TC only), the control of the electrostatics can be simplified significantly.

It has been discovered that the developed toner mass per unit area on the P/R is contributed primarily by 3 field functions, namely the dc donor to the photoreceptor P/R, the ac donor to the photoreceptor P/R, and the dc mag roll to donor roll fields. That is, $$DMA = f1(V_{don}, V_{exp}, \text{gap,tribo}) + f2(V_{jump}, \text{gap,adhesion,tribo}) +$$

$$f3(V_{dm},\text{gap},\text{TC},\text{tribo})$$

It can be seen that the parameters in f1 are very noisy with the exception of $V_{don}$. The parameters in f2 are also equally as noisy where adhesion is the adhesion force between the toner and the donor roll. On the other hand, the parameters in f3 are the least noisy and f3 is the only function that depends on TC as well as tribo.

By minimizing the contribution of f1, and minimizing the variations of f2, and maximizing the contribution of f3, a DMA dependency of, or relationship to TC/tribo can be developed. The equation is simplified to:

$$DMA=f2+f3(V_{dm},\text{gap},\text{TC},\text{tribo})$$

By taking the DMA difference of the 12.5% and 50% patches (or any low density and high density combinations) and given that the RR's are first order inverse functions of DMA, f2 can be reduced to a constant term and the relationship between the dRR (RR12.5%–RR50%) and TC/tribo becomes, $$d\text{RR}=C1*\text{tribo}*(\text{TC}+C0)/\text{TC}+C2$$

By controlling the differential patch (12.5% and 50%) value "dRR", a tribo and TC relationship can be controlled. Previous experiments showed that C0 is very close to unity, the above equation can be normalized with respect to environmental zones to a linear equation of dRR as a function of the A(t) to TC ratio:

$$d\text{RR}=C1*A(t)/\text{TC}+C2$$

where C1 and C2 are constants and A(t) equals tribo×(TC+1).

This turns out to be more desirable than a TC sensor which tries to control TC to a constant value. With the uncoupled control, high A(t)'s want high TC's and low A(t)'s want low TC's. This relationship will minimize the swing of tribo in all environmental zones.

More specifically, variations in toner concentration are adjusted by taking into account three factors. The first is a measure of the expected toner usage for each document. This is determined by a pixel count of documents to be imaged. The second factor is the difference between the value of the 12.5% target or patch and the 50% patch. That is, these targets are imaged and sensed by a toner area coverage sensor. There is, then, a calculation of the difference between the reflectance values of these targets which is compared to a reference value to provide an error value.

The third factor, not nearly as significant as the first two factors, is the sensed signal from the same TAC sensor from an 87.5% patch. The controller responds to these three factors to determine a time period of dispense for the toner dispenser.

In accordance with the present invention, toner concentration control is a function of three measurements, in particular, pixel count, sensed reflectance of an 87.5% reflectance patch in the interdocument zone, and the change or delta of reflectance measured by two patches in the image area, a 12.5% reflectance patch and a 50% reflectance patch. The delta reflectance is the difference between the 12.5% reflectance patch and the 50% reflectance patch. It should be noted that it has been discovered that this delta reflectance is a very good indication of toner concentration.

At machine warm-up, there is an initial toner concentration set up procedure. This procedure uses only the 12.5% and 50% reflectance patches in the image area of the photoreceptor. The reflectance of these two patches is sensed by a toner area coverage sensor and the difference of the two readings or sensed signals is compared to a target reference stored in suitable memory two provide an error signal. If this error signal is higher than the reference signal then there is an indication of too much toner in the developer system. At some minimal value above the reference value, it is necessary to deplete some of the toner from the developer system. This is done by making dummy images on the photoreceptor, developing the images on the photoreceptor, but then cleaning the photoreceptor of the existing toner without transfer to a copy sheet. After a given number of dummy images, the system is then rechecked.

These dummy images are essentially large patches with approximately 25% area coverage. Again, the 12.5% and 50% patches will be developed and sensed and the difference between the signals compared to a reference signal to provide an error signal. If the error signal is within an acceptable range, no further adjustment is necessary. However, if the error signal is still greater than the reference by a sufficient amount, the making of dummy images to clean off more toner and deplete the toner in the developer system would again be repeated. If on the other hand, the delta reflectance signal is less than the reference signal and the difference between the two signals (the error signal) is less than the reference by sufficient amount, it is necessary to add toner to the developer system. In such a situation, it is simply necessary to run the toner dispense mechanism for a given length of time, in a preferred embodiment eighteen pitches, to add toner to the toner sump. The system is again checked and adjustments made until the system is within a given range.

Once the toner concentration set up has been made, there is a toner concentration control adjustment made periodically during machine operation. In a preferred embodiment, this is done at the end of a job at the cycle down or for an extended job, after the completion of a given number of copies, such as 300 copies. Three variables are monitored to make the adjustment. One is the pixel count of documents being imaged, which is a strong indicator of a need for adjustment and another is the sensed 87.5% reflectance patch in the interdocument zone which is a relatively weak indicator of the adjustment to be made. The third variable is factored into making the adjustment in the change of reflectance between the 12.5% density patch and the 50% density patch. This is done in the image area either at the cycle out after the job completion or during a skipped pitch during an extended job. This third factor is also a strong indicator of the need for adjustment in the status of toner concentration.

The difference between the toner area coverage sensor measurement of the 12.5% patch and the 50% patch is compared to a reference value to produce an error signal. This error signal along with the pixel count value as well as the 87.5% reflectance patch signal are then used to make an adjustment. Typically, the adjustment is to make no adjustment if the toner concentration is at a relatively high level and if the toner concentration is at a relatively low concentration level, the adjustment is to turn on the toner dispense mechanism to add toner from the toner container or bottle via a toner carrying auger to the development housing. Depending upon the measurements, there is a given duty cycle or time of operation of the toner dispense.

Figure 5:
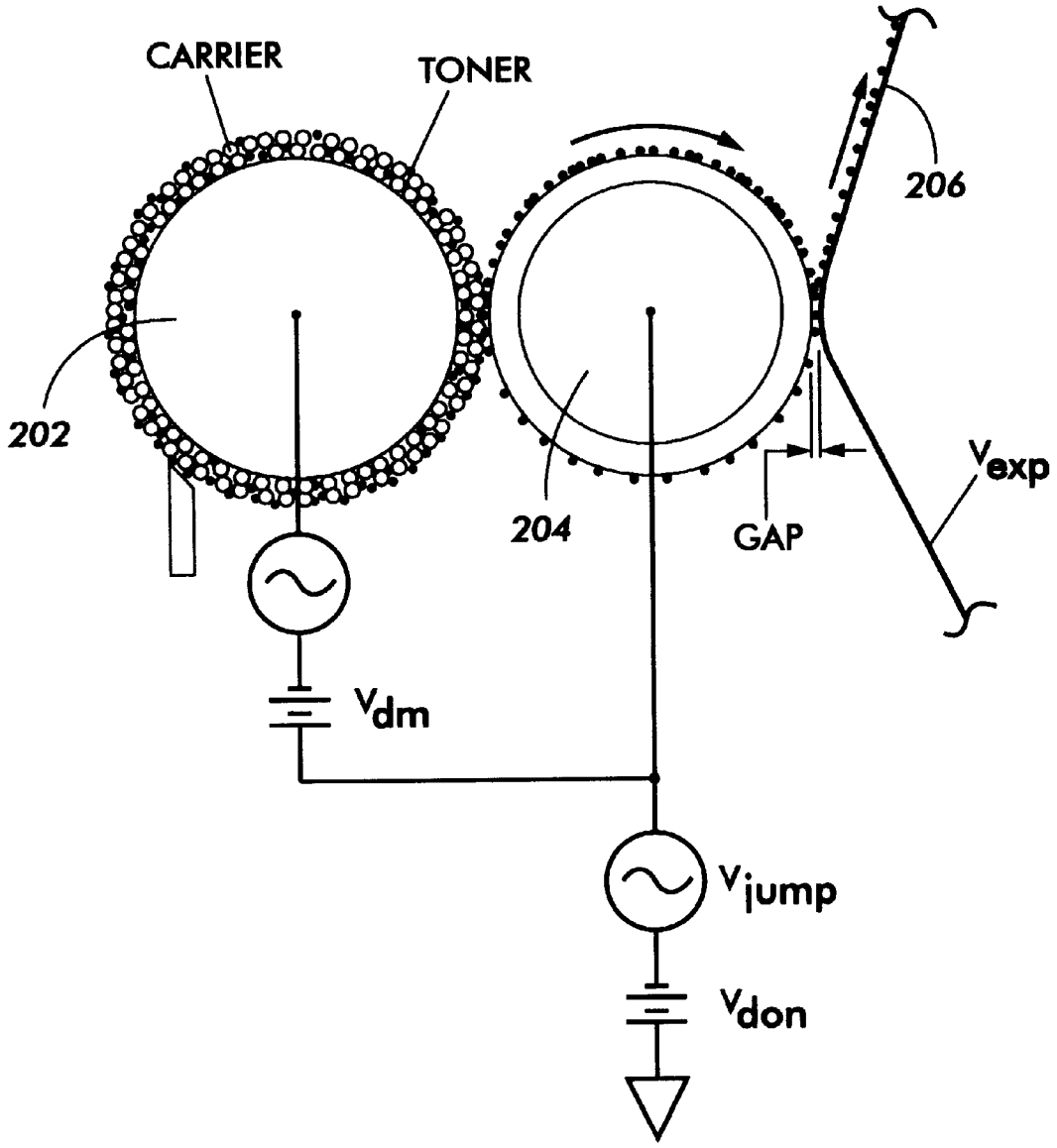
FIG. 5 is a schematic of hybrid jumping development illustrating the present invention.

With reference to FIG. 5, there is illustrated a schematic of hybrid jumping development including two component donor roll loading and single component photoreceptor development. In particular, a mag roll 202 with a layer of carrier and toner particles as shown, provides toner particles to doner roll 204 to provide toner to develop an image on photoreceptor 206. A small gap separates the donor roll 204 from photoreceptor 206. Voltage, $V_{exp}$, represents the exposure voltage on the photoreceptor, the voltage on the photoreceptor after exposure. Also, voltage $V_{dm}$ represents the bias voltage between the donor roll 204 and the mag roll 202, voltage $V_{don}$ represents the donor voltage, and voltage $V_{jump}$ represents the donor AC voltage potential as shown in FIG. 5.

Figure 6:
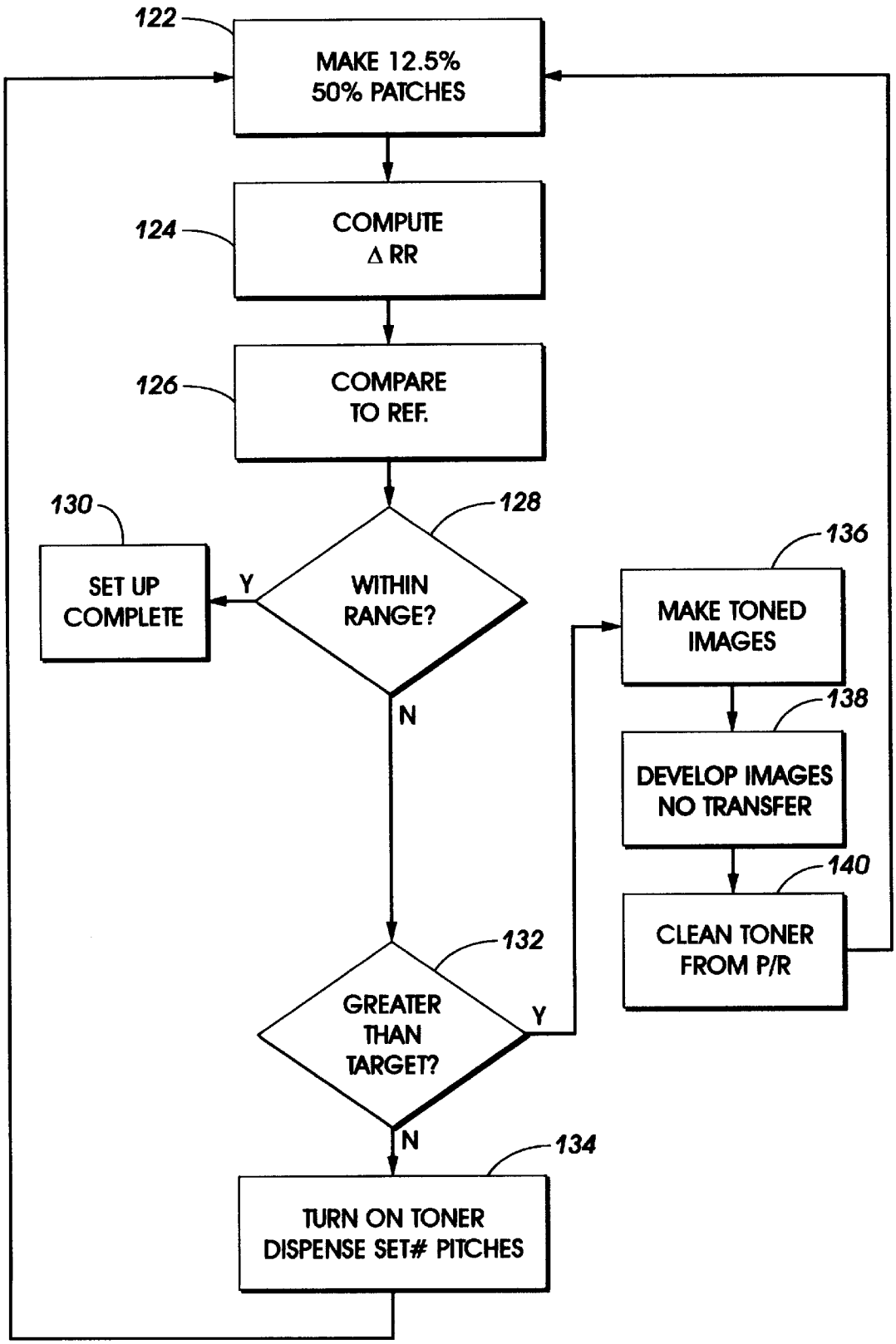
FIG. 6 is a flow chart illustrating a TC set up procedure for uncoupled toner concentration and tribo control in accordance with the present invention.

With reference to FIG. 6, there is illustrated a flow chart the toner concentration set up. In particular, at block 122 the 12.5% and 50% patches are laid down, developed and sensed in the image area of the photoreceptor. At block 124, there is a computation of the change in reflectance, compared to a reference value as illustrated at block 126 and a determination made at decision block 128 whether or not the comparison is within a given range or target. If within the acceptable range, the set up is complete shown at block 130. If not, there is a determination shown at decision block 132 whether or not the compared or error signal is greater than the range. If not, meaning, there is less toner concentration than desirable, as shown at block 134 there is a turn on of the toner dispense for a set number of pitches. If on the other hand, the measurement is greater than the range, meaning a greater toner concentration than desired, a procedure to clean toner out of the toner housing is initiated as shown at block 136, in particular, 25% toner images are projected on the photoreceptor but not transferred to a copy sheet but rather cleaned off the photoreceptor. This is shown at blocks 138 and 140 as a means to deplete toner from the toner housing. Upon cleaning toner from the photoreceptor there is a return to block 122 to make further patches for sensing a determination as to whether or not the concentration is now within range.

Figure 7:
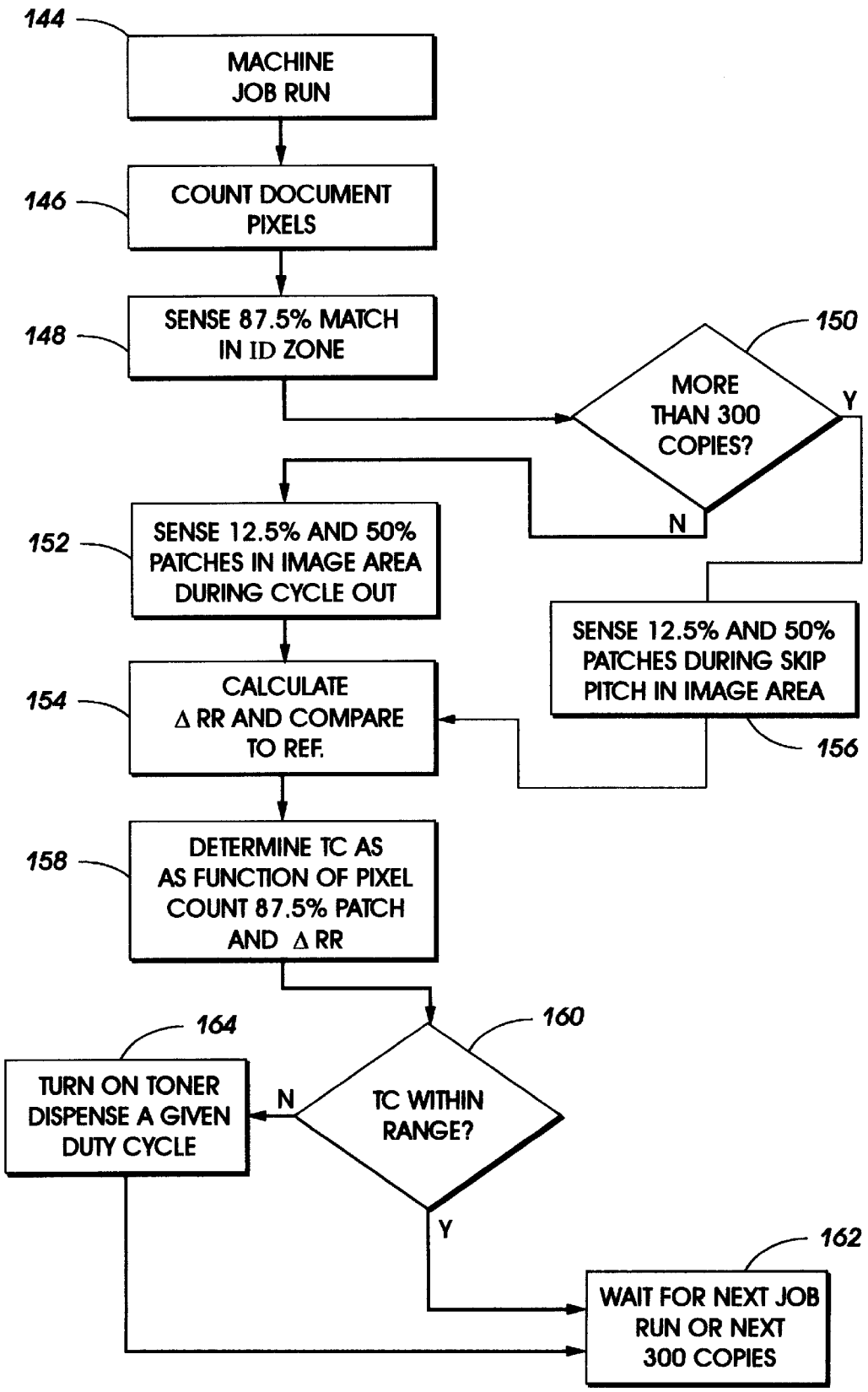
FIG. 7 is a flow chart illustrating a TC run time control procedure for uncoupled toner concentration and tribo control in accordance with the present invention.

FIG. 7 illustrates toner concentration control during machine job run shown at block 144. In particular during job run, there is a count of document pixels illustrated at block 146 and a sensing of a 87.5% patch in the inter document zone as shown at block 148. If it is a large job, greater than 300 copies, as determined at block 150, then there is a sensing of the 12.5% and 50% patches during a skip pitch in the image area during the job run as shown at 156. If the job is less than 300 copies, the 12.5% and 50% patches are imaged in the image area during cycle out of the job run as shown at 152. In block 154 there is a calculation of the difference of the 50% and 12.5% patches which is compared to a reference and at block 158 a determination of the actual toner concentration as a function of the pixel count, the 87.5% patch and the change of reflectance from the 12.5% and 50% patches. If the toner concentration is within range as determined at block 160 then the next step as shown at block 162 is to wait for the next job run or the next 300 copies. If the toner concentration is not within range, the toner dispense is turned on a given number of duty cycles. New measurements will then be made as required as shown in block 164.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In a printing machine having a moving imaging surface, a projecting system for projecting an image onto the imaging surface, a developer with a toner dispenser for application of toner to the image projected onto the imaging surface for transfer of the image to a medium, the developer including a housing and a toner dispenser for dispensing toner into the housing, a method of adjusting variations in toner concentration comprising the steps of;

determining a pixel count of documents to be imaged, providing first, second, and third test targets on the imaging surface, sensing the reflectance value of the first and second test targets on the imaging surface, calculating the difference between the reflectance value of the first and second test targets, comparing the difference between the reflectance value of the first and second test targets to a reference value to provide an error value, sensing the third test target and responding to the error value, the reflectance value of the third test target and the pixel count of documents to be imaged to determine a time period of dispense for the toner dispenser.

2. The method of claim 1 including a toner area coverage sensor to sense the reflectance value of the first and second test targets.

3. The method of claim 1 wherein the first test target is about 12.5% reflectance and the second test target is about 50% reflectance.

4. The method of claim 1 wherein the third test target is about 87.5% reflectance.

5. The method of claim 4 wherein the third test target is provided in the interdocument zone of the imaging surface.

6. The method of claim 1 wherein the first and second test targets are provided in the image area of the imaging surface.

7. The method of claim 6 wherein the first and second test targets are sensed during machine cycle down.

8. In a printing machine having a moving imaging surface, a projecting system for projecting an image onto the imaging surface, a developer with a toner dispenser for application of toner to the image projected onto the imaging surface for transfer of the image to a medium, the developer including a housing and a toner dispenser for dispensing toner into the housing, and a toner area coverage sensor to sense reflectance values of test targets a method of adjusting variations in toner concentration comprising the steps of;

determining a pixel count of documents to be imaged, providing first, second, and third test targets on the imaging surface, the first test target having a relatively low reflectance and the second test target having a medium reflectance, first and second test targets being provided in the image area of the imaging surface sensing the reflectance value of the first and second test targets on the imaging surface, calculating the difference between the reflectance value of the first and second test targets, comparing the difference between the reflectance value of the first and second test targets to a reference value to provide an error value, sensing a third test target having a relatively high reflectance, and responding to the error value, the third test target and the pixel count of documents to be imaged to determine a time period of dispense for the toner dispenser.

9. The method of claim 8 wherein the third test target is provided in the interdocument zone of the imaging surface.

10. The method of claim 8 wherein the first and second test targets are sensed during machine cycle down.

11. The method of claim 8 wherein the dispense rate for the toner dispenser is grams per second and the time period of dispense for the toner dispenser is an off-on duty cycle.

* * * * *